United States Patent [19]

Nagati

[11] 4,260,141

[45] Apr. 7, 1981

[54] CENTERPLATE WEAR LINERS

[75] Inventor: Rashed N. Nagati, Mars, Pa.

[73] Assignee: Pennsylvania Engineering Corporation, Pittsburgh, Pa.

[21] Appl. No.: 57,758

[22] Filed: Jul. 16, 1979

[51] Int. Cl.[3] ..... C21C 3/10

[52] U.S. Cl. ..... 266/287; 266/165

[58] Field of Search ..... 266/165, 287

[56] References Cited

U.S. PATENT DOCUMENTS

| | | | |
|---|---|---|---|
| 1,890,150 | 12/1932 | Giese | 266/165 |
| 1,974,532 | 9/1934 | De Fries | 266/165 |
| 3,039,627 | 6/1962 | Sayre | 266/165 |
| 4,135,703 | 1/1979 | Nagati | 266/165 |

*Primary Examiner*—P. D. Rosenberg

[57] ABSTRACT

A centerplate wear liner for hot metal mixer cars includes a split ring side wear liner having a shroud on its outer surface. The shroud fits within an annular groove machined into the socket which receives the centerplate. A disc wear liner is placed within the ring wear liner and serves both as a wear liner and as a locking device to prevent the shroud of the side wear liner ring from escaping from the groove.

11 Claims, 2 Drawing Figures

CENTERPLATE WEAR LINERS

FIELD OF THE INVENTION

The present invention relates generally to the art of wear liners and more particularly to centerplate wear liners useful with hot metal mixer cars and other similar apparatus.

BACKGROUND OF THE INVENTION

In the art of steelmaking, hot metal mixer cars are used to transport loads of molten metal from one location in a steel plant to another location. Such cars are frequently moved by rail using specially designed carriages which permit the large cars to negotiate horizontal curves in the track.

One type of mixer car in common use comprises a transportable, elongate, refractory-lined cylindrical vessel suitably mounted for rotation about its longitudinal axis. Portability of the vessel is achieved by mounting its rotational bearings on spaced apart railroad-type trucks with the vessel spanning the gap therebetween. The vessel is also provided with a pouring spout which permits the discharge of molten metal when the vessel is tilted.

In addition to the components of the mixer cars which permit longitudinal rotation of the car, the trucks include bearing systems which permit the individual trucks to rotate horizontally about a vertical axis. Typically a rigid bolster on the truck supports the car and longitudinal rotational components, a ceterplate member being provided on the bottom of each bolster. These centerplates engage mating sockets on the trucks. In one known design, the centerplate is generally convex and is designed to rest against a generally concave lower socket member. This type of system is described in U.S. Pat. No. 4,135,703 issued Jan. 23, 1979 to Nagati et al. for "Mobile Hot Metal Mixer." In another type of prior art design the centerplate comprises a generally circular centerplate having a planar bearing surface adapted for being received in a circular socket.

One problem with the latter type of mixer cars is the wear which occurs to the centerplate and socket. One solution which has been suggested includes providing a vertical, wear-resistant sleeve about the sides of the socket and a planar wear-resistant disc on the bottom of the socket. While this design has resulted in reduced downtime and permits relatively easy repair of the bearing assembly, it has been found that the sleeves can be displaced vertically under operating conditions that force angular movement of the span bolster with respect to the centerplate. A wear liner design which overcomes the above-noted disadvantage of the prior art would be a significant advance in this technology.

OBJECTS OF THE INVENTION

It is a primary object of the present invention to provide a centerplate wear liner for hot metal mixer cars which overcomes the above-noted disadvangages of the prior art.

Another object of the present invention is to provide a centerplate wear liner system which cannot be displaced under operating conditions.

A further object of the invention is to provide a wear liner system which is easy to fabricate and which may be removed and replaced when necessary.

Yet another object of the present invention is to provide a wear liner system which may be added to existing mixer cars.

A still further object of the present invention is to provide a wear liner system usable in a variety of applications.

How these and other objects of the invention are accomplished will be described in the following specification, taken in conjunction with the figures. Generally, however, the liner system of the present invention includes a machined groove in the socket which holds the shroud of a split ring side wear liner. The side wear liner is installed first and is welded to the socket casting if desired. A disc plate wear liner is then lowered into the space within the side wall liner and serves the dual purposes of acting as a planar surface wear liner and as a locking device that prevents the side wear liner ring from escaping from the groove.

DESCRIPTION OF THE PREFERRED EMBODIMENT

Figure 1:
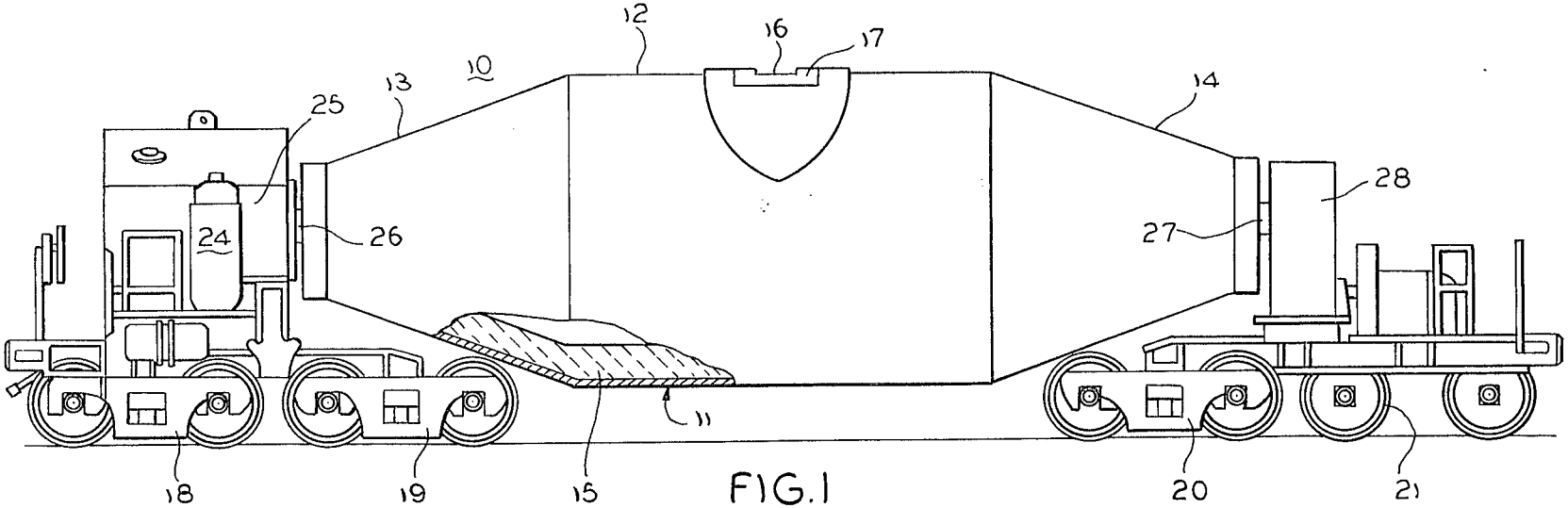
FIG. 1 is a side elevation of an illustrative molten metal mixer car with which the wear liner system of the present invention may be used.

FIG. 1 shows a side elevation view of a mobile hot metal mixer car 10 with which the wear liner system of the present invention may be used. The mixer car 10 comprises a metal shelled vessel 11 which is fusiform in shape and has a generally cylindrical central portion 12 and generally conical end portions 13 and 14. The vessel shell is lined with refractory material 15 of any suitable type. The shell 11 and lining 15 have aligned openings 16 at the top to permit charging the mixer vessel with molten hot metal and discharging the same therefrom after it is moved and/or processed. The pouring opening 16 has a pouring lip 17 for side pouring when the vessel is rotated or angulated about its longitudinal axis.

Vessel 11 is mounted on spaced apart sets of railroad trucks 18 and 19, constituting one set, and 20 and 21 constituting another set. The sets of trucks are respectively joined by bolsters 22 and 23 which serve as equilizers and allow the trucks to rotate about a vertical axis for negotiating horizontal curves. One of the trucks carries a pressurized air tank 24 which may be used to operate a pneumatic motor in a housing 25 for turning the mixer on its longitudinal axis. The rotating machinery within housing 25 need not be described since it is known to the art and does not in and of itself form part of the present invention. In any event, a trunnion spindle 26 extends from the drive end of the mixer and is operatively coupled to the rotating machinery in housing 25 for angulating mixer vessel 11 about its longitudinal axis. At the idler end of the mixer there is another trunnion spindle 27 which is journaled in suitable bearings, not shown, that are supported on a post, not shown, which is in a housing 28 and mounts on span bolster 23. The trunnion spindle 26 at the front or drive end is journaled similarly to the rear or idle end of the trunnion spindle just described.

Before beginning the description of the wear liner system of the present invention, it should be understood that the particular mixer car just described is one of many types of such vessles with which the present invention can be used. It should also be recognized that the present invention may be employed with cars other than those specifically involved in the steelmaking art. Of course, the numerous components of the mixer car 10 were not described at all because they are conventional; e.g. the motor for moving car 10, the car braking system, etc.

Referring now to the particulars of the present invention, it can be noted that housing 28 is supported on bolster 23 and is rotatable with respect thereto. At the other end of car 10, the housing 25 containing the rotating equipment is also rotatable with respect to bolster 22 upon which it is supported. The following description of a wear liner system will be with particular reference only to the housing 28—bolster 23 coupling but it should be understood that a similar system is incorporated at the other end of car 10.

Figure 2:
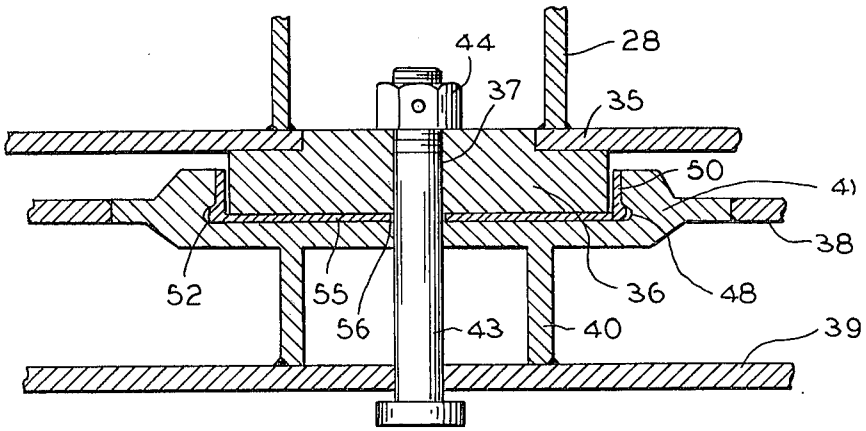
FIG. 2 is an exploded side cross section of the centerplate portion of the mixer car shown in FIG. 1 illustrating the details of the wear liner system of the present invention.

Referring now to FIG. 2, housing 28 is partially shown to include a horizontal bottom plate 35. A circular disc-shaped centerplate 36 is welded to the plate 35, plate 36 having an axial opening 37 therethrough. Span bolster 23, in the illustrated embodiment, includes upper and lower plate members 28 and 39 respectively with supporting and spacing struts 40 located therebetween. The span bolster 23 may be formed as a unitary casting or using other known fabrication techniques. A circular socket 41 is formed in upper plate member 38, the socket being slightly larger in diameter and slightly smaller in height than centerplate 36. From this description it will be apparent that centerplate 36 is received within socket 41 in such manner that housing 28 and plate 35 can rotate with respect to bolster 23. Vertical movement between housing 28 and span bolster 23 is restrained by a kingpin 43 and nut 44, the kingpin passing vertically through centerplate 36 and upper and lower bolster plate members 38 and 39.

The wear liner system of the present invention includes a groove 48 machined in socket 41. The groove 48 is located at the bottom of socket 41 and completely surrounds the centerplate receiving area of the socket. While the preferred method of forming groove 48 is by machining same, the present invention includes other groove forming techniques, e.g. forming socket 41 from a casting which includes the groove. Groove 48 need have only a small depth, e.g. between about ½ to 2 inches.

The next feature of the present invention is a vertical, wear resistant liner ring 50 which preferably is constructed from manganese steel but may be constructed from bronze, plastic materials or other specially designed materials selected for the particular adaptation of the wear liner system. Liner ring 50 has a height which is substantially equal to the depth of socket 41 and includes a shroud 52 at its outside surface adapted for being received within groove 48.

To facilitate the insertion of liner ring 50 it is preferably split at one location and is sprung, gibbed and welded into place. The welds are preferably located at the top and outside of vertical liner 50, an area thereof which is readily accessible for removal of the weld when replacement or repair of liner ring 50 is required.

The final feature of the wear liner system of the present invention is a circular disc wear liner 55 which is adapted to be placed within socket 41 and which includes a central opening 56 for the kingpin 43. While not essential, it is preferred that disc 55 be welded to liner ring 50 so that the disc performs the dual functions of a wear liner and a restraint against liner ring 50 being displaced inwardly. In other words, the disc 55 insures that shroud 52 remains in groove 48. Disc 55 is preferably constructed of manganese steel but may be prepared from a wide variety of other materials as was discussed for liner ring 48.

In use, the liner system of the present invention prevents wear of centerplate 36 and the socket 41 even if the centerplate is subjected to vertical forces such as those which occur when the trucks 18–21 negotiate curves within the steel plant. The system may also be readily adapted to existing centerplate systems simply by forming a groove in the socket and inserting the liner components 48 and 55 as described above. Following an extended period of use, one or both of components 48 and 55 may become damaged to such an extent that repair or replacement is required. In this event, nut 44 is removed from the kingpin 43. The housing 28 with its centerplate 36 is lifted vertically to permit access to the wear liners. The welds between disc 55 and ring 48 are removed and the disc is vertically elevated. The welds between ring 48 and socket 41 are then removed to permit removal of ring 48 by springing one side of the ring inwardly to cause removal of shroud 52 from groove 48.

While the present invention has been described with particular reference to a single illustrated embodiment, the invention has wider applicability. For example, the wear restraining properties of the system are applicable to devices which are quite small as well as those involving the very large steel handling equipment depicted in the drawings. Moreover, the system of the present invention can line parts which have surface coatings, lubricants, or very thin layers of hard wear-resistant alloys. Furthermore, the invention is not to be restricted to the dimensional relationships of the drawings. In summary, the scope of the invention should be limited solely by the claims which follow.

I claim:

1. A centerplate liner system for preventing wear between a circular centerplate and a circular recessed socket adapted for receiving and supporting the centerplate in rotational contact therewith, said system comprising:

an annular liner means disposed within said socket and surrounding the periphery of said centerplate, said annular liner being constructed of a wear-resistant material;

a generally planar liner means disposed in said socket, and below said centerplate said planar liner means being constructed of a wear-resistant material; and means for restraining vertical movement of said annular liner means out of said socket.

2. The invention set forth in claim 1 wherein said restraining means comprises a circular groove formed in the side wall of said socket, and shroud means on said annular liner means aligned with said groove.

3. The invention set forth in any of claims 1 and 2 wherein said annular liner means is secured in said socket and said planar liner means is secured to said annular liner means.

4. The invention set forth in claim 2 wherein said annular liner means is split to permit insertion of said shroud means into said groove.

5. In combination, an elongate metallurgical mixer vessel;

support means for supporting opposed ends of said mixer vessel and permitting rotation of same about its longitudinal axis;

spaced apart railroad truck means for moving said mixer vessel;

means for rotatably coupling said support means to said truck means comprising circular disc-shaped centerplate means on said support means and a socket means on said truck means for receiving said centerplate means;

annular liner means disposed within said socket and surrounding the periphery of said centerplate means, said annular liner means being constructed of wear-resistant material;

generally planar liner means disposed in said socket means and below said centerplate means, said planar liner means being constructed of a wear-resistant material; and means for restraining vertical movement of said annular liner means.

6. The invention set forth in claim 5 wherein said restraining means comprises a circular groove formed in the side wall of said socket means, and shroud means on said annular liner means aligned with said groove.

7. The invention set forth in either of claims 5 and 6 wherein said annular liner means is affixed in said socket and said planar liner means is affixed to said annular liner means.

8. The invention set forth in claim 6 wherein said annular liner means is split to permit insertion of said shroud into said groove.

9. In combination, an elongate metallurgical mixer vessel;

support means for supporting opposed ends of said mixer vessel and permitting rotation of same about its longitudinal axis;

spaced apart railroad truck means for moving said mixer vessel;

means for rotatably coupling said support means to said truck means including a generally circular plate having planar top and bottom surfaces and a generally cylindrical side wall;

a circular socket on said truck means for receiving said plate, said socket having a generally planar horizontal surface and generally vertical side wall, the diameter of said socket exceeding that of said plate;

kingpin means passing vertically along the axis of said plate and said socket to permit only horizontal rotation of said plate within said socket;

an annular groove in the side wall of said socket; and a wear-resistant liner disposed in said socket and comprising a first generally cylindrical liner ring adjacent the vertical wall of said socket and including an annular shroud engaging said groove and a circular disc liner disposed within said socket and adapted for being located intermediate said plate and said socket.

10. The invention set forth in claim 9 wherein said liner is constructed of manganese steel and wherein said disc liner and liner ring are secured to one another whereby said disc liner prevents inward movement of said side wall liner and prevents said shroud from escaping from said groove.

11. The invention set forth in claim 9 wherein said disc liner and liner ring are secured to one another whereby said disc liner prevents inward movement of said side wall liner and prevents said shroud from escaping from said groove.

* * * * *